US007723906B2

(12) United States Patent
Kadowaki et al.

(10) Patent No.: US 7,723,906 B2
(45) Date of Patent: May 25, 2010

(54) SPARK PLUG DESIGNED TO MINIMIZE DROP IN INSULATION RESISTANCE

(75) Inventors: Satoru Kadowaki, Mie-ken (JP); Yasutake Ishino, Kariya (JP)

(73) Assignee: Denso Corporation, Kariya (JP)

( * ) Notice: Subject to any disclaimer, the term of this patent is extended or adjusted under 35 U.S.C. 154(b) by 210 days.

(21) Appl. No.: 11/951,578

(22) Filed: Dec. 6, 2007

(65) Prior Publication Data

US 2008/0136305 A1 Jun. 12, 2008

(30) Foreign Application Priority Data

Dec. 8, 2006 (JP) ..... 2006-331749
Jul. 26, 2007 (JP) ..... 2007-194666

(51) Int. Cl.
*H01T 13/20* (2006.01)

(52) U.S. Cl. ..... 313/143

(58) Field of Classification Search ..... 313/118–145
See application file for complete search history.

(56) References Cited

U.S. PATENT DOCUMENTS 6,091,185 A * 7/2000 Matsubara et al. ..... 313/138
6,215,233 B1 * 4/2001 Matsubara ..... 313/118
6,335,587 B1 * 1/2002 Matsubara ..... 313/141

FOREIGN PATENT DOCUMENTS

| | | |
|---|---|---|
| JP | UM S57-104481 | 6/1982 |
| JP | UM S61-014490 | 1/1986 |
| JP | H03-001474 | 1/1991 |
| JP | H06-196247 | 7/1994 |
| JP | 2002-260815 | 9/2002 |
| JP | 2002-270332 | 9/2002 |

OTHER PUBLICATIONS

Korean Office Action dated Apr. 29, 2009, issued in corresponding Korean Application No. 10-2007-0126461, with English translation.

* cited by examiner

*Primary Examiner*—Karabi Guharay
*Assistant Examiner*—Brenitra M Lee
(74) *Attorney, Agent, or Firm*—Nixon & Vanderhye PC

(57) ABSTRACT

A spark plug for an internal combustion engine is provided which includes a metal shell, a porcelain insulator, a center electrode, and a ground electrode. The center electrode is retained in the porcelain insulator to define a spark gap between itself and the ground electrode. The porcelain insulator has a nose made up of an upright portion and a tapered portion continuing from the upright portion toward a top end thereof. The tapered portion has a diameter decreasing toward the top end of the porcelain insulator. The upright portion has an outer wall extending substantially parallel to an inner wall of the metal shell, thereby inducing the formation of side sparks between the tapered portion and the metal shell before the insulation resistance between the center electrode and the metal shell drops, thereby giving a signal indicative of such an event to an operator.

11 Claims, 12 Drawing Sheets

SPARK PLUG DESIGNED TO MINIMIZE DROP IN INSULATION RESISTANCE

CROSS REFERENCE TO RELATED DOCUMENT

The present application claims the benefit of Japanese Patent Application No. 2006-331749 filed on Dec. 8, 2006, and Japanese Patent Application No. 2007-194666 filed on Jul. 26, 2007, disclosure of which is totally incorporated herein by reference.

BACKGROUND OF THE INVENTION

1. Technical Field of the Invention

The present invention relates generally to a spark plug for internal combustion engines which may be used in automotive vehicles, co-generation systems, or gas feed pumps, and more particularly to such a spark plug designed to ensure the stability of insulation resistance.

2. Background Art

FIGS. 13 and 14 illustrate a spark plug 9 as a typical example for use in internal combustion engines. The spark plug 9 includes a metal shell 94 with an external plug mounting thread 941, a porcelain insulator 92 retained inside the metal shell 94, a center electrode 93 disposed in the porcelain insulator 92, and a ground electrode 95 welded to the metal shell 94 to define a spark gap 911 between itself and the tip of the center electrode 93.

Usually, low-speed running of the engine may cause the engine to smolder, so that combustion of an air-fuel mixture produces carbon which is adhered to the surface of a nose 922 of the porcelain insulator 92. An increase in deposit of the carbon may create a conductive connection between the center electrode 93 and the metal shell 94, thus decreasing an dielectric resistance greatly therebetween. This may result in a failure in producing spark discharges in the spark gap 911. This tends to take place, especially in high heat range spark plugs) that is, spark plugs with a short insulator nose.

The above phenomenon found in the spark plug 9 will be analyzed below with reference to FIG. 15.

Carbon particles C are deposited in sequence from the tip to the base of the insulator nose 922 located inside the metal shell 94.

The insulator nose 922 of the spark plug 9 is, as can be seen in FIG. 14, shaped to have the diameter decreasing gradually from an outer annular shoulder 921 placed in abutment with an inner annular shoulder 942 of the metal shell 94 to the tip thereof. In other words, the insulator nose 922 is so designed that an air gap between itself and the inner wall of the metal shell 94 decreases from the tip thereof toward the outer annular shoulder 942. The increase in deposit of the carbon particles C on the insulator nose 922, therefore, results in a decrease in interval between the surface of a layer of the carbon particles C and the inner wall of the metal shell 94. When such an interval reaches a certain value, it will cause sparks (also called side sparks) to form between the outer surface of the insulator nose 922 and the metal shell 94.

Further increasing of the deposits of carbon particles C on the insulator nose 922 will result in the formation of an electrical connection between the center electrode 93 and the metal shell 94, thereby decreasing the insulation resistance greatly therebetween.

The deterioration in insulation resistance between the center electrode 93 and the metal shell 94 arising from smoldering of the engine may be alleviated by increasing the speed of the engine to elevate the temperature in the combustion chamber to burn off the carbon particles C settling on the surface of the porcelain insulator 92. The time of formation of the side sparks may be viewed as an indication of a suitable time when the carbon deposits is to be burned off. Specifically, the formation of the side sparks indicates the fact that a greater amount of carbon deposits have settled on the insulator nose 922, which also shows a suitable time when any measures should be taken to burn off the carbon deposits. The formation of the side sparks represents the occurrence of the so-called tracking (i.e., the creation of a conductive path through which the side sparks travel) within the engine which the vehicle operator usually perceives as mechanical vibrations of the engine.

The structure of the spark plug 9, however, has the problem in that the interval between the insulator nose 922 and the metal shell 94 decreases at a constant rate from the tip of the insulator nose 922 to the outer annular shoulder 921, thus causing a short circuit to be formed between the metal shell 94 and the center electrode 93 in a small amount of time after the side sparks are created, which leads to a difficulty for the vehicle operator to take measures to burn off the carbon deposits on the spark plug 9 after perceiving the occurrence of the tracking. There is also another problem that when the vehicle operator has perceived the tracking and stopped the engine, it may result in a failure in restarting the engine due to a great decrease in insulation resistance between the center electrode 93 and the metal shell 94 (i.e., the ground electrode 95) resulting from the deposit of carbon particles C on the insulator nose 922.

The shape of the insulator nose 922 having the diameter decreasing gradually from the outer annular shoulder 921 placed in abutment with the inner annular shoulder 942 of the metal shell 94 to the tip thereof results in a difficulty for the heat to be transferred or dissipated toward the base of the insulator nose 922. Therefore, a rapid elevation in temperature in the combustion chamber of the engine arising from, for example, sudden acceleration of the vehicle may cause the insulator nose 922 to be subjected to a great stress.

The poor transferring of the heat away from the insulator nose 922 will result in an increased temperature of the insulator nose 922. Thus, when the insulator nose 922 to which fuel is adhered is cooled rapidly, it will cause the insulator nose 922 to experience a great stress, which may lead to breakage thereof.

The above described deterioration of the insulation resistance between the center electrode 93 and the metal shell 94 due to the carbon deposit on the insulator nose 922 or the breakage of the insulator nose 922 tends to occur, especially in high-power engines mounted in tuned up cars.

Japanese Patent No. 2953227 teaches a park plug in which the base of the insulator nose 922 facing the inner annular shoulder 942 of the metal shell 94 is designed to have the width great enough to improve the dielectric strength thereof. This structure is, however, not designed to form the carbon deposit-caused side sparks promptly.

SUMMARY OF THE INVENTION

It is therefore a principal object of the invention to avoid the disadvantages of the prior art.

It is another object of the invention to provide an improved structure of a spark plug for internal combustion engines which is designed to induce the formation of side sparks early which signal a drop in insulation resistance between a center electrode and a metal shell of the spark plug and minimize thermal stress on a porcelain insulator.

According to one aspect of the invention, there is provided a spark plug for an internal combustion engine which comprises: (a) a hollow metal shell having an inner shoulder formed on an inner wall thereof; (b) a porcelain insulator having an outer shoulder formed on an outer wall thereof, the porcelain insulator being disposed inside the metal shell in abutment of the outer shoulder with the inner shoulder of the metal shell so as to extend in a longitudinal direction of the spark plug; (c) a center electrode disposed inside the porcelain insulator; (d) a ground electrode joined to the metal shell to define a spark gap between itself and the center electrode; and (e) an insulator nose that is a portion of the porcelain insulator and continues from the outer shoulder to a top end of the porcelain insulator. The insulator nose includes an upright portion and a tapered portion extending from the upright portion to the top end of the porcelain insulator. The upright portion has an outer peripheral surface extending substantially parallel to a longitudinal center line of the spark plug. The tapered portion is shaped to have a diameter decreasing from the upright portion toward the top end of the porcelain insulator. The tapered portion has an outer peripheral surface shaped to have an outline one of extending straight and being curved outwardly on a plane, as defined to extend through the longitudinal center line the spark plug.

Usually, low-speed running of the engine may cause the engine to smolder, so that combustion of an air-fuel mixture produces carbon particles. The carbon particles are deposited in sequence from the top to the base of the insulator nose because the tapered portion faces inside the combustion chamber (i.e., the spark gap).

The insulator nose is shaped to have the diameter decreasing gradually from the outer shoulder to the top thereof. In other words, the insulator nose is so designed that an air gap between itself and the inner wall of the metal shell decreases from the top thereof toward the outer shoulder. The increase in deposit of the carbon particles on the insulator nose, therefore, results in a decrease in interval between the surface of a layer of the carbon particles and the inner wall of the metal shell. When such an interval reaches a certain value, it will cause sparks (so called side sparks) to form between the outer surface of the insulator nose and the metal shell.

With an increase in amount of deposit of the carbon particles, they will also begin to be adhered to the outer periphery of the upright portion. The upright portion, however, extends straight in parallel to the longitudinal center line (i.e., the central axis) of the spark plug. In other words, the circumferential surface of the upright portion does not face the top of the spark plug, thus increasing a difficulty of depositing of the carbon particle having entered beyond the gap between the top of the upright portion and the inner wall of the metal shell on the circumferential surface of the upright portion.

The upright portion has a constant diameter, so that the distance between itself and the inner wall of the metal shell is kept constant in the longitudinal direction of the porcelain insulator. Therefore, even when the deposit of the carbon particles grows continuously deep into the gap between the upright portion and the inner wall of the metal shell, much time will be required until the distance between a carbon-deposited area of the upright portion and the inner wall of the metal shell decreases enough to induce the side sparks, thus consuming a great deal of time before the insulation resistance between the center electrode and the metal shell drops undesirably.

The configuration of the porcelain insulator, thus, creates the side sparks well before the insulation resistance between the center electrode and the metal shell drops, thus ensuring much time between start of formation of the side sparks and the drop in insulation resistance, thereby permitting the operator of the engine to perceive the tracking (i.e., formation of a conductive path between the porcelain insulator and the metal shell through which the side sparks travel) resulting in mechanical vibrations of the engine and to take measures to eliminate the smoldering of the engine.

Specifically, it allows, after perceiving the tracking, the operator to accelerate the engine to elevate the temperature in the combustion chamber to burn off the carbon deposits on the surface of the porcelain insulator and also enables the engine to be restarted after the operator perceives the tracking and stops the engine. This is because when the tracking occurs, a required degree of insulation resistance is still secured between the center electrode and the metal shell.

The insulator nose has the upright portion having a constant diameter without tapering, thus facilitating ease of transferring of the heat to which the top of the tapered portion has been subjected away to the upright portion, thus alleviating the thermal stress acting on the insulator nose causing the breakage thereof.

The tapered portion is designed to have the outline extending straight or curved on the plane, as defined to extend through the longitudinal center line of the spark plugs thereby facilitating the ease of transmission of the heat to the base of the tapered portion and also reducing the concentration of stress on the boundary between the tapered portion and the upright portion to minimize the breakage of the insulator nose.

In the preferred mode of the invention, the upright portion may have a length of 1.5 mm to 6 mm. The upright portion has a length selected to lie in a range of 7% to 40% of a total length which is the sum of lengths of the outer shoulder and the insulator nose. This ensures an increased time between the formation of the side sparks the drop in insulation resistance between the center electrode and the metal shell.

The size Gm of the spark gap and the distance Gs between the inner wall of the metal shell and an outer periphery of a boundary between the upright portion and the tapered portion of the porcelain insulator are selected to meet a relation of $Gm \geqq Gs \geqq 0.4\ Gm$, thereby resulting in early formation of the side sparks which will be a signal indicating the possibility of a drop in insulation resistance between the center electrode and the metal shell.

The upright portion of the insulator nose has an outer surface continuing to an outer surface of the tapered portion through a rounded surface shaped to have an outline curved on a plane, as defined to extend through the longitudinal center line of the spark plug, there by alleviating the concentration of stress on the interface between the upright portion and the tapered portion.

The center electrode may have a noble metal chip joined to a top end thereof which faces the spark gap. The noble metal chip has a diameter of 0.7 mm or less, preferably 0.45 mm or less, thereby decreased the voltage required by the spark plug to produce a sequence of sparks. The noble metal chip may be made of Iridium alloy to enhance the durability of the spark plug.

The total length that is the sum of lengths of the outer shoulder of the porcelain insulator and the insulator nose is 11 mm or less, thereby facilitating the transmission of heat from the insulator nose to the metal shell. This permits the spark plug to be engineered as a high-heat range type.

The metal shell has an inner peripheral surface which extends from the inner shoulder to a top end thereof facing the spark gap in parallel to the longitudinal center line of the spark plug. The inner peripheral surface of the upright portion of the porcelain insulator, therefore, extends parallel to the inner peripheral surface of the metal shell. Additionally, the gap between the tapered portion of the porcelain insulator and the inner peripheral surface of the metal shell is widened toward the top of the porcelain insulator, thereby minimizing the adhesion of carbon to the outer surface of the upright portion while ensuring the gap between a carbon-adhered area of the porcelain insulator and the inner periphery of the metal shell at an initial stage of deposition of carbon on the porcelain insulator.

The metal shell may have a protrusion formed on the top end portion thereof facing the spark gap. The protrusion extends inwardly of the metal shell, thus reducing the amount of carbon entering the air pocket between the porcelain insulator and the metal shell.

The distance Gp between an inner end surface of the protrusion and the outer wall of the porcelain insulator and the size Gm of the spark gap are selected to meet a relation of $Gm \leqq Gp \leqq 1.8\ Gm$. This ensures the formation of a sequence of reliable sparks between the center electrode and the ground electrode and also minimizes the entrance of carbon into an air pocket between the metal shell and the porcelain insulator.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
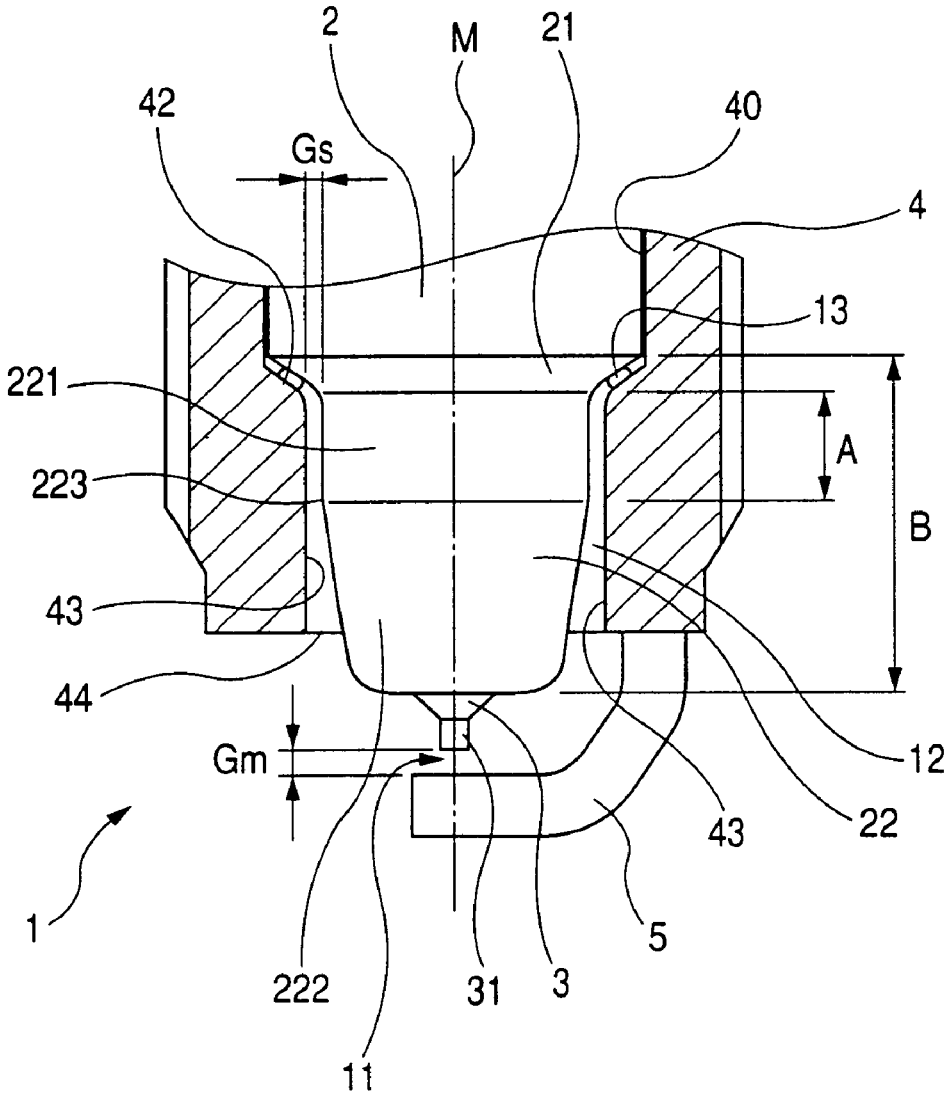
FIG. 1 is a partially longitudinal sectional view which shows a top portion of a spark plug according to the first embodiment of the invention.

Referring to the drawings, wherein like reference numbers refer to like parts in several views, particularly to FIGS. 1 to 4, there is shown a spark plug 1 for use in internal combustion engines according to the first embodiment of the invention.

Figure 2:
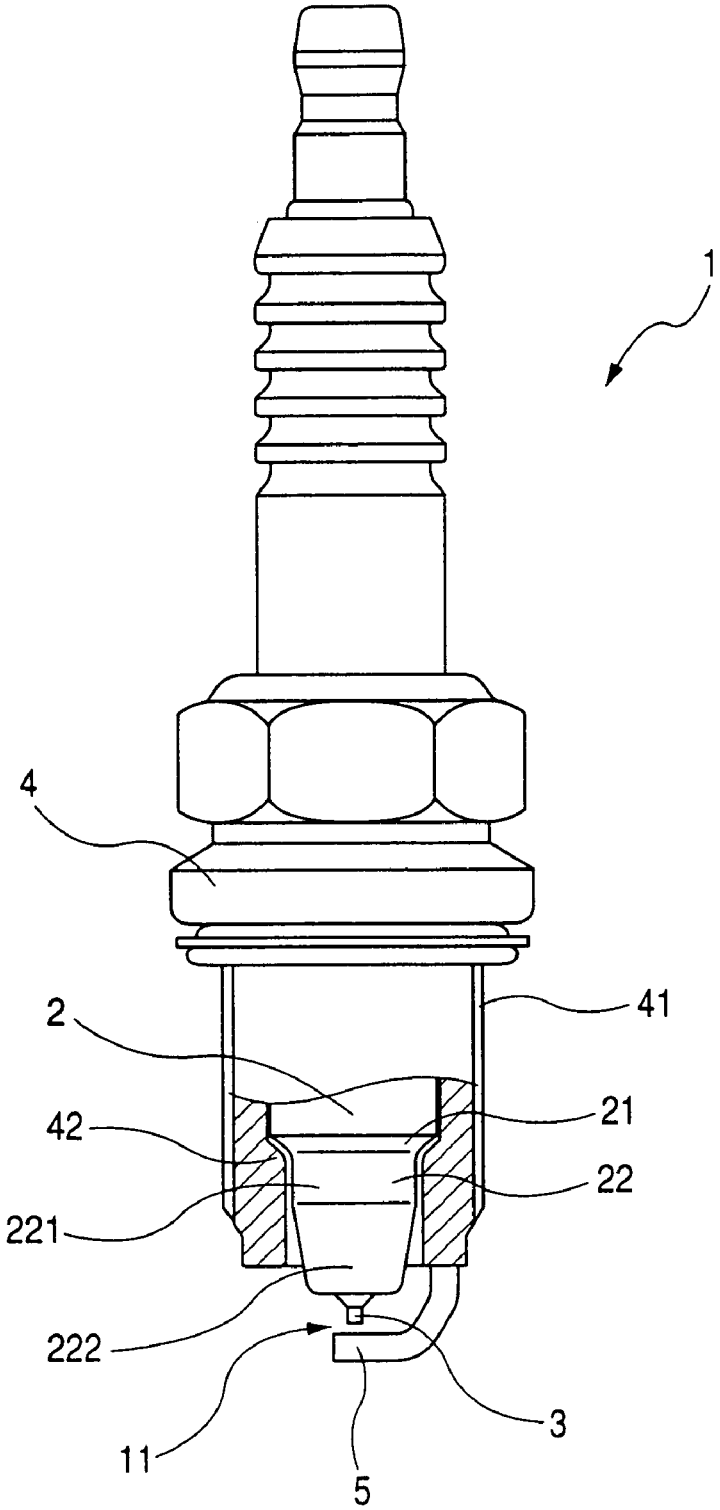
FIG. 2 is a side view which shows a spark plug according to the first embodiment of the invention.

The spark plug 1, as illustrated in FIGS. 1 and 2, includes a hollow cylindrical metal shell 4, a porcelain insulator 2, a center electrode 3, and a ground electrode 5. The metal shell 4 has formed on an outer periphery thereof a plug-mounting thread 41 for installation of the spark plug 1 in the internal combustion engine. The porcelain insulator 2 is retained in the metal shell 4. The center electrode 3 is fit in the porcelain insulator 2 and has a tip 31 exposed outside the top of the porcelain insulator 2 to define a spark gap 11 between itself and the ground electrode 5.

The porcelain insulator 2 includes an outer annular shoulder 21 placed in abutment with an inner annular shoulder 42 of the metal shell 4 and a nose 22 extending from the outer annular shoulder 21 toward the top of the spark plug 1.

The insulator nose 22 continues from the outer annular shoulder 21 and is made up of an upright portion 221 and a tapered portion 222. The upright portion 221 has an outer peripheral wall extending substantially parallel to a central axis M of the spark plug 1 (i.e., a longitudinal center line of the porcelain insulator 2). The tapered portion 222 has a diameter decreasing at a constant rate from the upright portion 221 to the top face of the insulator nose 22.

The tapered portion 222 has an outer surface extending evenly, but however, may alternatively be shaped to have an outwardly bulged (i.e., curved) outer surface.

The upright portion 221 has a length A of 1.5 mm to 6 mm, as defined in the longitudinal direction of the spark plug 1. The length A is also selected to lie in a range of 7% to 40% of a total length B of a top portion of the porcelain insulator 21 which is the sum of lengths of the outer annular shoulder 21 and the insulator nose 22. The length B is selected to be 11 mm or less.

The metal shell 4 has formed therein an axial bore 40 through which the porcelain insulator 2 extends. The axial bore 40 has the inner annular shoulder 42 formed on an inner wall thereof. The axial bore 40 also has a front inner peripheral wall 43 extending from the inner annular shoulder 42 to the top end 44 of the metal shell 4 in parallel to the central axis M of the spark plug 1. The front inner peripheral wall 43, thus, has an inner diameter constant along the length thereof.

The front inner peripheral wall 43 of the metal shell 4 is disposed to face the outer periphery of the insulator nose 22 in a radial direction of the spark plug 1, thereby defining a cylindrical air pocket 12 therebetween. The air pocket 12 opens at the top end 44 of the metal shell 4.

The outer annular shoulder 21 of the porcelain insulator 2 is placed on the inner annular shoulder 42 of the metal shell 42 through a gasket 13.

The size or length Gm of the spark gap 11, as defined along the central axis M of the spark plug 1, and the distance Gs between the inner wall of the metal shell 4 and the outer wall of the upright portion 221 (i.e., at least an outer periphery of a boundary between the upright portion 221 and the tapered portion 222) of the porcelain insulator 2 are selected to meet a relation of $Gm \geqq Gs \geqq 0.4\ Gm$.

Figure 3:
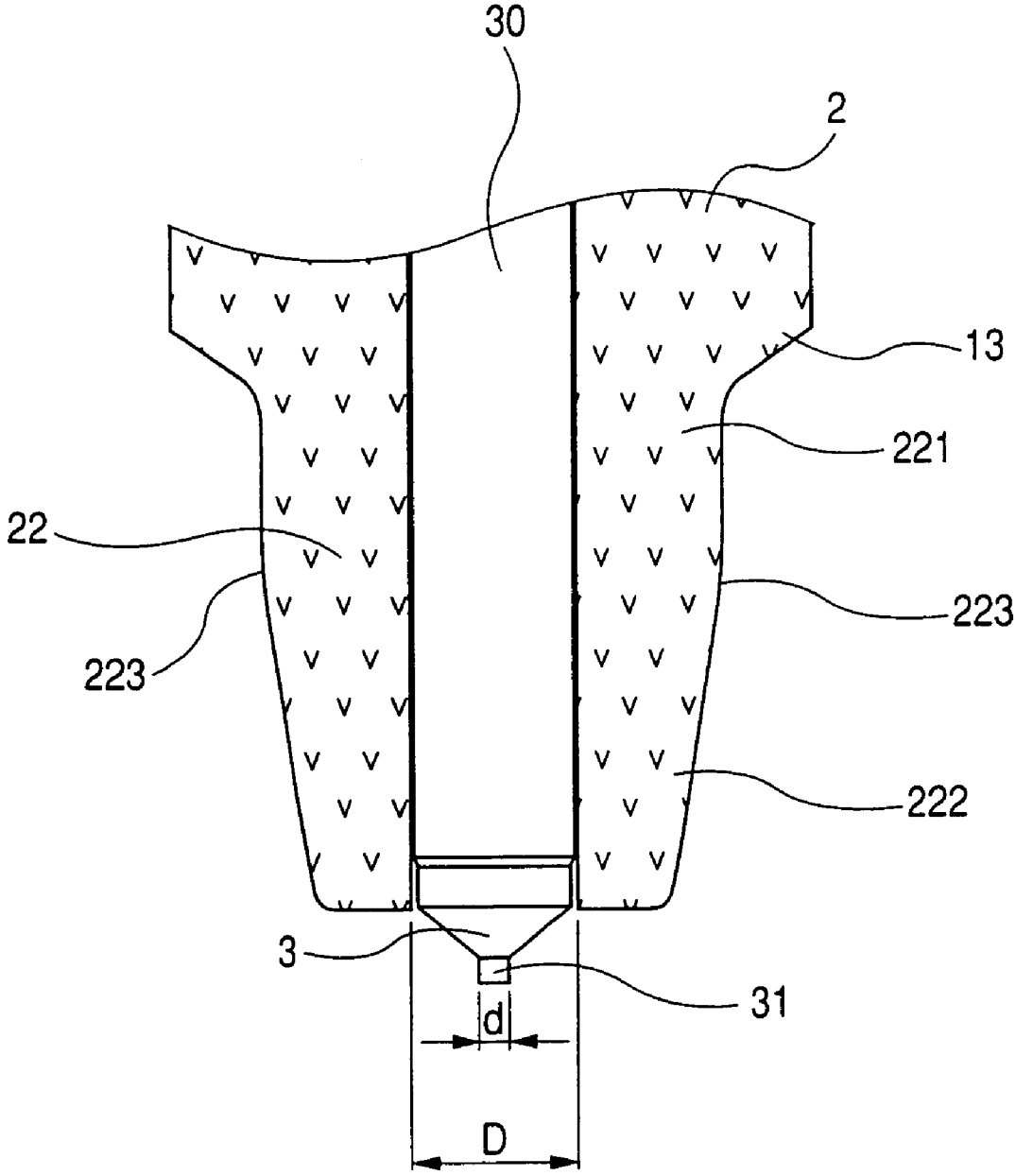
FIG. 3 is a partially longitudinal sectional view which shows a structure of an insulator nose of the spark plug of FIG. 2.
Figure 4:
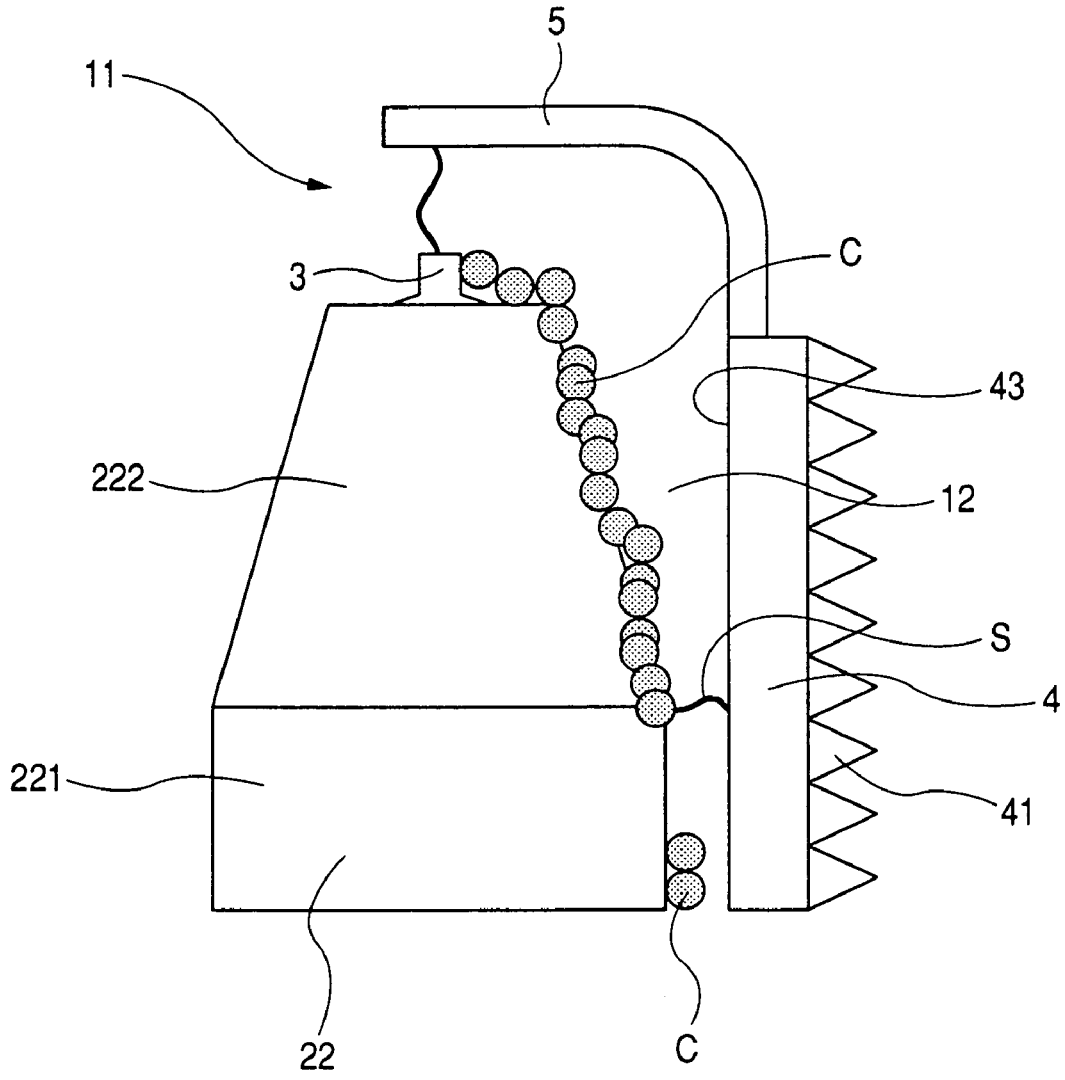
FIG. 4 is a partially longitudinal sectional view which shows processes of adhesion of carbon to the insulator nose, as illustrated in FIG. 3.

The outer surface of the upright portion 221 is, as clearly illustrated in FIG. 3, connected to that of the tapered portion 222 through a rounded surface 223. The radius of curvature of an outline of the rounded surface 223, as defined on a plane extending through the central axis M of the spark plug 1, is selected to be about 2 mm.

The center electrode 3 has the noble metal chip 31 made of an Ir (Iridium) alloy. The noble metal chip 31 has a diameter d of 0.7 mm or less, and preferably 0.45 mm or less.

The center electrode 3 has a cylindrical base body 30 fit in the porcelain insulator 2. The base body 30 has a tapered head to which the noble metal chip 31 is welded. The diameter D of the base body 30 is 2 mm to 3 mm.

The beneficial advantages of the spark plug 1 will be described below.

The insulator nose 22 is, as described above, made up of the upright portion 221 and the tapered portion 222. This structure causes, as can be seen from FIG. 4, carbon particles C to be adhered to the tapered portion 222 progressively from the top to the base thereof. The tapered portion 222 is shaped to have the diameter increasing toward the upright portion 221, so that the interval between itself and the inner wall of the metal shell 4 decreases gradually toward the upright portion 221. In other words, the circumferential surface of the tapered portion 222 faces to the top of the spark plug 1. This facilitates depositing of the carbon particles C on the tapered portion 222, so that the amount thereof increases with time, thus decreasing the distance between a carbon-deposited area of the insulator nose 22 and the inner wall of the metal shell 4. When such a distance reaches a certain value, it will cause side sparks S to form between the porcelain insulator 2 and the metal shell 4. With an increase in amount of deposit of the carbon particles C, they will also begin to be adhered to the outer periphery of the upright portion 221. The upright portion 221 however, extends straight in parallel to the central axis M of the spark plug 1. In other words, the circumferential surface of the upright portion 221 does not face the top of the spark plug 1, thus increasing a difficulty of depositing of the carbon particle C having entered beyond the gap between the top of the upright portion 221 and the inner wall of the metal shell 4 on the circumferential surface of the upright portion 221.

The upright portion 221 has a constant diameter, so that the distance between itself and the inner wall of the metal shell 4 is kept constant in the longitudinal direction of the porcelain insulator 2. Therefore, even when the deposit of the carbon particles C grows continuously deep into the gap between the upright portion 221 and the inner wall of the metal shell 4, much time will be consumed until the distance between a carbon-deposited area of the upright portion 221 and the inner wall of the metal shell 4 decreases, thus consuming a great deal of time before the insulation resistance between the center electrode 3 and the metal shell 4 drops undesirably.

The structure of the porcelain insulator 2, thus, secures much time between start of formation of the side sparks and drop in insulation resistance between the center electrode 3 and the metal shell 4, thereby permitting the vehicle operator to perceive the tracking inducing the formation of the side sparks, which usually results in mechanical vibrations of the engine, and to take measures to eliminate the smoldering of the engine. Specifically, it allows, after perceiving the tracking, the vehicle operator to accelerate the engine to elevate the temperature in the combustion chamber to burn off the carbon deposits on the surface of the porcelain insulator 2 and also enables the engine to be restarted after the vehicle operator perceives the tracking and stops the engine. This is because when the tracking occurs, a required degree of insulation resistance is still secured between the center electrode 3 and the metal shell 4.

The insulator nose 22 has the upright portion 221 having a constant diameter without tapering, thus facilitating ease of transferring of the heat to which the top of the tapered portion 222 has been subjected away to the upright portion 221, thus alleviating the thermal stress acting on the insulator nose 22 which usually causes the breakage thereof.

The tapered portion 222 is designed to have an outline extending straight or curved on a plane, as defined to extend through the central axis M of the spark plug 1, thereby facilitating the ease of transmission of the heat to the base of the tapered portion 222 and also reducing the concentration of stress on the boundary between the tapered portion 222 and the upright portion 221 to minimize the breakage of the insulator nose 22.

The upright portion 221 has a length A of 1.5 mm to 6 mm, thereby ensuring a lot of time between the start of formation of side sparks and the drop in insulation between the center electrode 3 and the metal shell 4.

The length A of the upright portion 221 is also selected to lie in a range of 7% to 40% of a total length B of the top portion of the porcelain insulator 21 which is the sum of lengths of the outer annular shoulder 21 and the insulator nose 22, thereby ensuring an increased time between the start of formation of side sparks and the drop in insulation between the center electrode 3 and the metal shell 4.

The length Gm of the spark gap 11 and the distance Gs between the inner wall of the metal shell 4 and the outer wall of the upright portion 221 of the porcelain insulator 2 are selected to meet a relation of $Gm \geqq Gs \geqq 0.4\ Gm$, thereby promoting induction of the side sparks early which signal the drop in insulation resistance between the center electrode and the metal shell 4.

The outer surface of the upright portion 221 leads to that of the tapered portion 222 through the rounded surface 223, thereby decreasing the concentration of stress on the boundary between the upright portion 221 and the tapered portion 222 greatly, which ensures the durability of the porcelain insulator 2.

The center electrode 3 has the Ir alloy-made noble metal chip 31 whose diameter is 0.7 mm or less, thereby decreasing the voltage required by the spark plug 1 to create sparks and improving the endurance of the spark plug 1.

The length B that is the sum of lengths of the outer annular shoulder 21 and the insulator nose 22 is selected to be 11 mm or less, thereby increasing the heat range of the spark plug 1, that is, facilitating the transferring of heat to which the insulator nose 22 is subjected away to the metal shell 4, which ensures the endurance of the spark plug 1 against use under severe conditions where the combustion chamber of the engine is subjected to intense heat.

Usually, typical high-heat range spark plugs tend to smolder the fuel mixture, but however, the structure of the spark plug 1 facilitates the ease of taking action to eliminate such smoldering, thus ensuring an increased service life of the spark plug 1.

We performed tests to evaluate anti-smoldering properties of the spark plug 1 in terms of the insulation resistance between the center electrode 3 and the metal shell 4.

Figure 13:
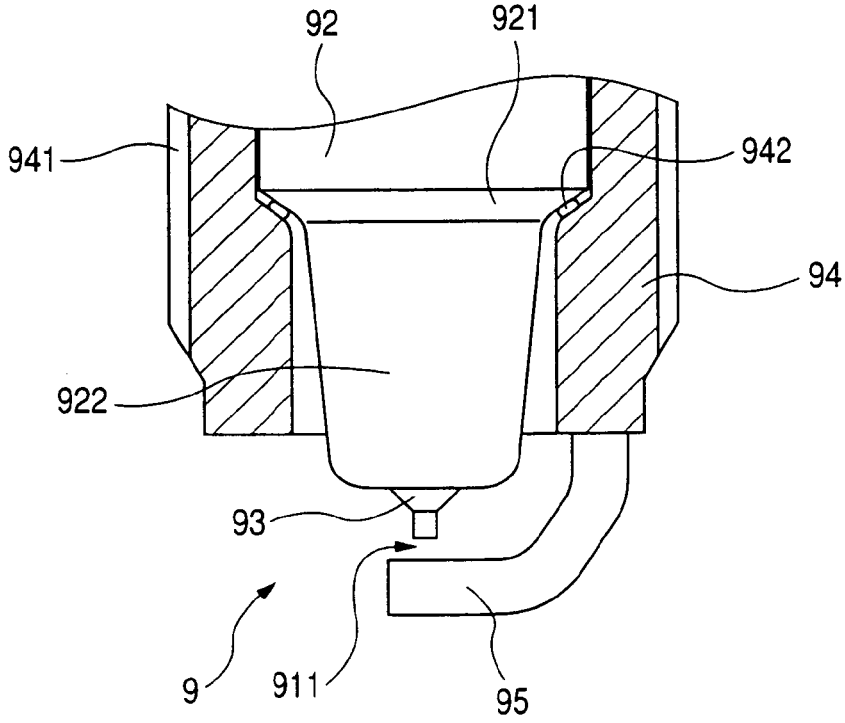
FIG. 13 (PRIOR ART)
FIG. 13 is a partially longitudinal sectional view which shows a top portion of a conventional spark plug.
Figure 14:
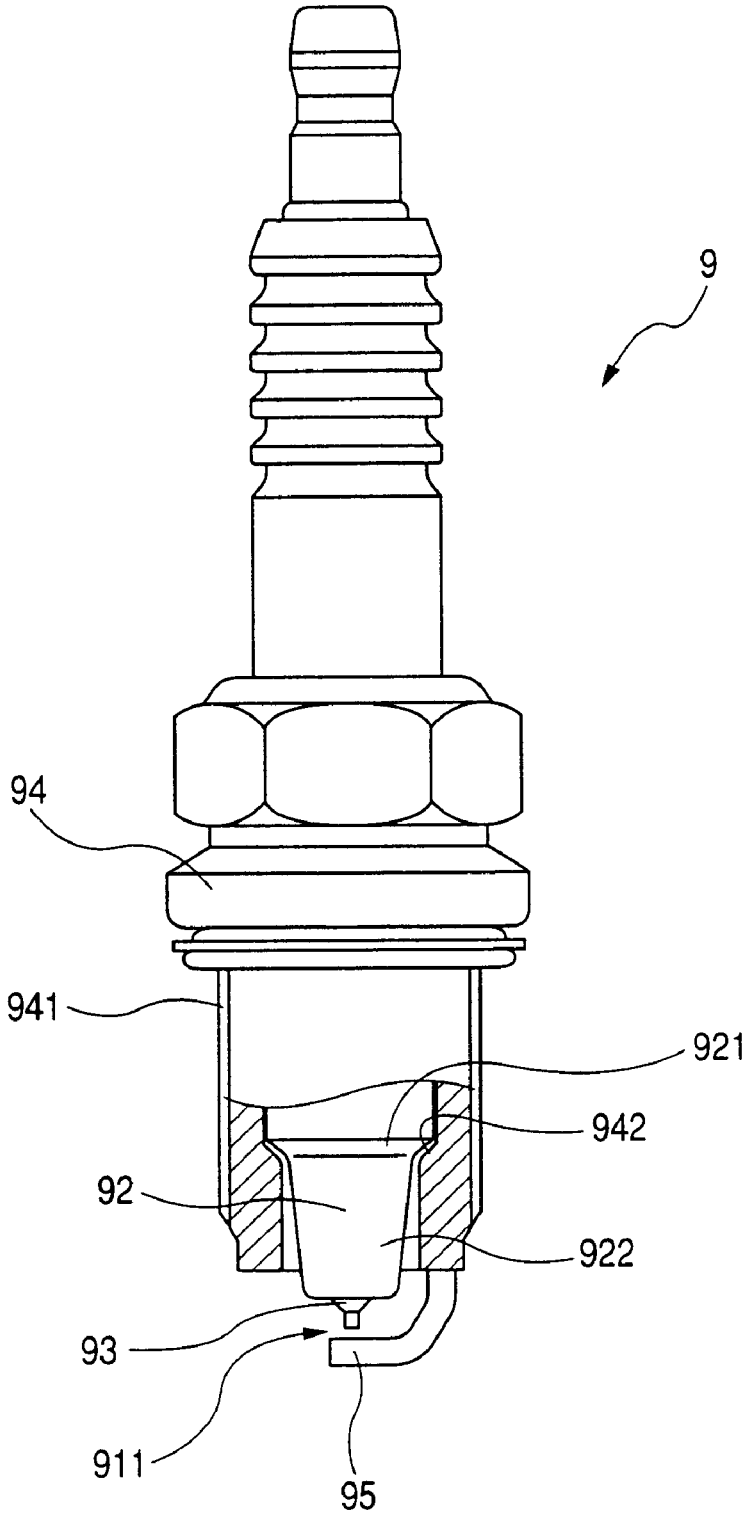
FIG. 14 (PRIOR ART)
FIG. 14 is a side view which shows the whole of the conventional spark plug, as illustrated in FIG. 13.
Figure 15:
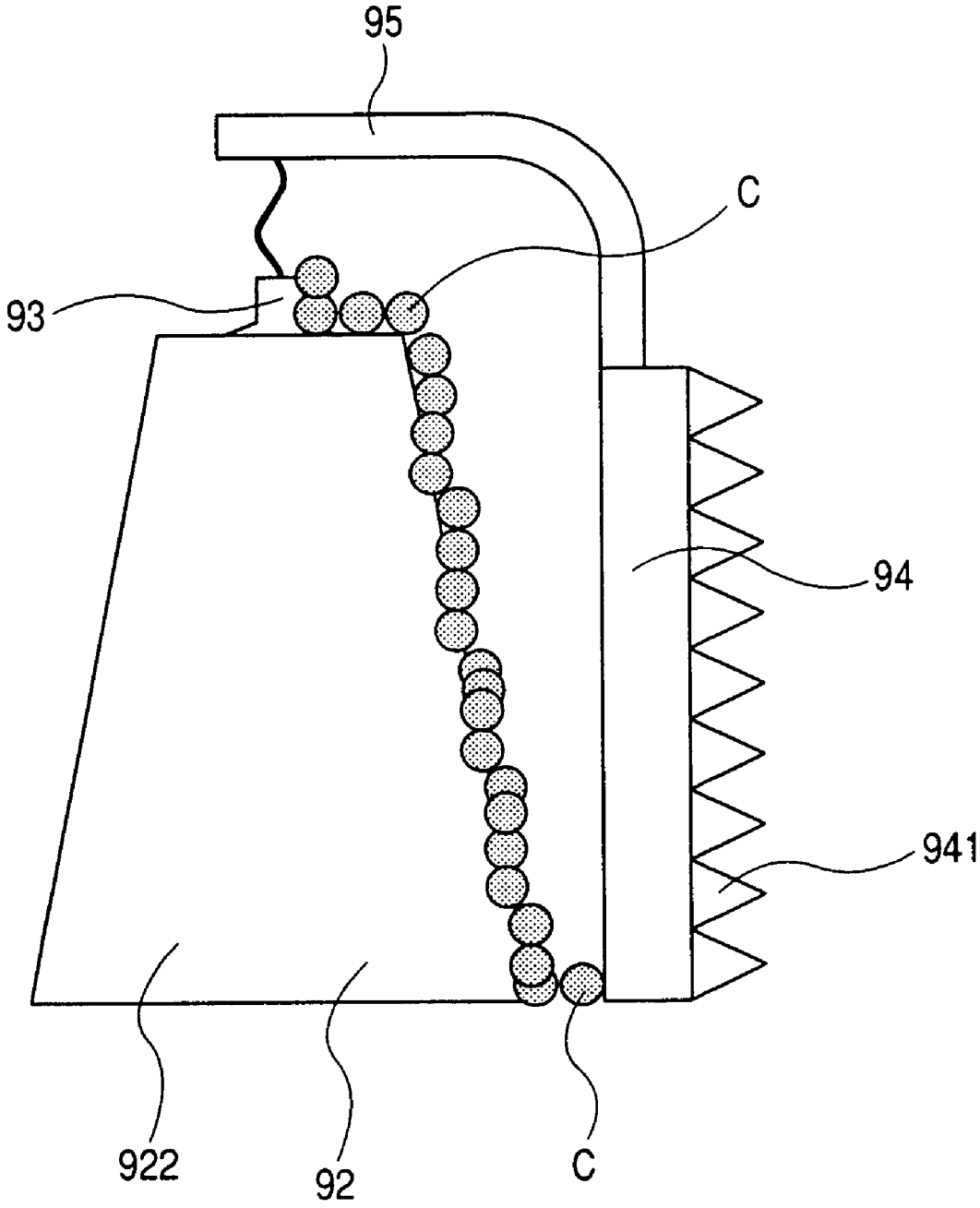
FIG. 15 (PRIOR ART)
FIG. 15 is a partially longitudinal sectional view which shows processes of adhesion of carbon to an insulator nose of the conventional spark plug, as illustrated in FIGS. 13 and 14.

We prepared four plug samples which were identical in structure with the spark plug 1 of FIG. 1 and four comparative plug samples which were identical in structure with the one of FIGS. 13 and 14 and had a porcelain insulator with a tapered nose without an upright portion, like the one 221 in FIG. 1.

We installed each of the plug samples in an internal combustion engine mounted in a test automobile and run the test automobile under conditions, as described below. We stopped the engine sixty (60) seconds after the porcelain insulator was covered with carbon so that the tracking occurred. We measured the insulation resistance between the center electrode and the metal shell before and after each test.

The engine mounted in the test automobile was a 223 cc one-cylinder four-cycle engine. We run the test automobile at a constant speed of 40 km/h on an even road. The temperature of engine coolant was 30° C.

We monitored a sequence of sparks, as created by each of the plug samples, in the form of electrical waveform. We continued to run the engine for 60 seconds after the waveform representing the tracking inducing the side sparks was detected and then stopped the engine.

The dimensions of each of the plug samples are listed in Table 1 below. Note that the value following "±" or "+" represents a tolerance

TABLE 1

| | Invention sample | Comparative sample |
|---|---|---|
| Gm | 0.7 + 0.1 | 0.7 + 0.1 |
| Gs | 0.4 ± 0.1 | — |
| A | 3.0 ± 0.5 | — |
| B | 11 ± 0.2 | 11 ± 0.2 |
| d | 0.4 ± 0.05 | 0.4 ± 0.05 |
| D | 2.65 ± 0.10 | 2.1 ± 0.1 |

Unit: mm

Figure 5:
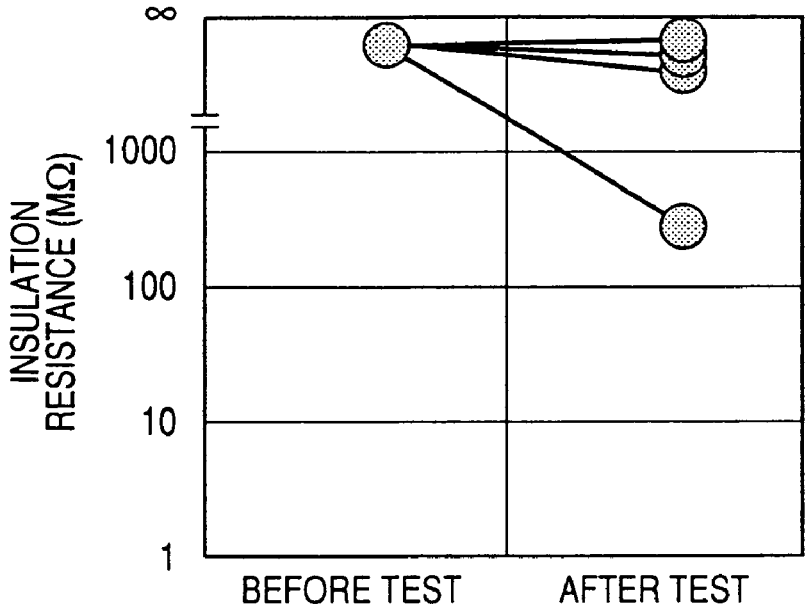
FIG. 5 is a graph which shows experimental results representing changes in insulation resistance between a porcelain insulator and a metal shell of samples of a spark plug in the first embodiment.
Figure 6:
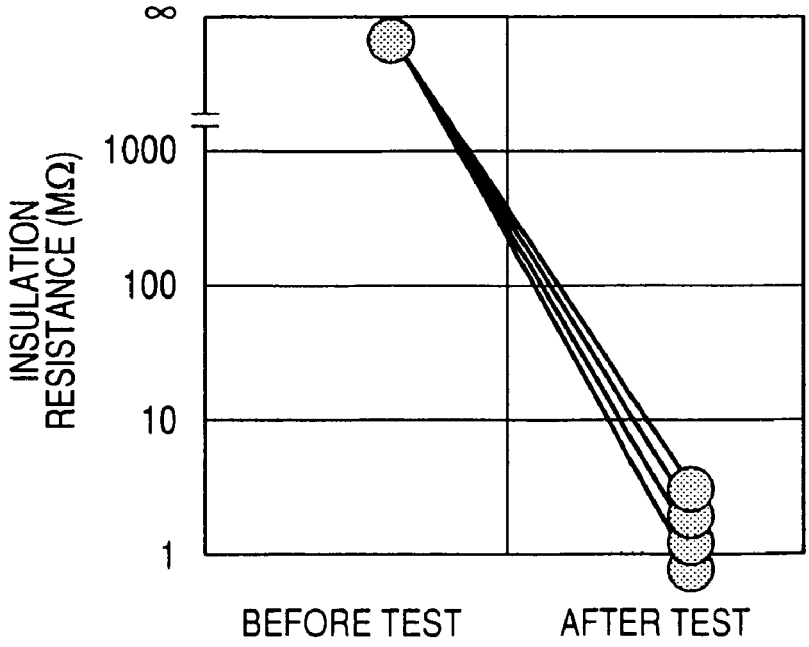
FIG. 6 is a graph which shows experimental results representing changes in insulation resistance between a porcelain insulator and a metal shell of comparative spark plugs.

The values of the insulation resistance between the center electrode and the metal shell of each of the plug samples, as measured before and after each test are shown in graphs of FIGS. 5 and 6. FIG. 5 represents the measured values of the insulation resistance in the plug samples (which will be referred to as invention plug samples below) identical in structure with the spark plug 1. FIG. 6 represents the measured values of the insulation resistance in the comparative plug samples.

The graphs of FIGS. 5 and 6 show that the insulation resistance of the comparative plug samples, as measured after the test, drops greatly, while that of the invention plug samples hardly drops and has a value above 500 MΩ. It is, therefore, found that the use of the spark plug 1 enables the engine to be restarted if it is stopped within 60 seconds after the tracking is taken place and that the smoldering or incomplete combustion of the engine may be alleviated to ensure reliable running of the engine by increasing the speed of the engine within 60 seconds after the occurrence of the tracking to elevate the temperature in the combustion chamber up to, for example, as high as 800° C., while the comparative plug samples have already dropped in insulation resistance greatly upon occurrence of the tracking, which may result in a failure in running the engine to elevate the temperature in the combustion chamber or restarting the engine.

We also performed thermal durability tests on the porcelain insulator 2 of the spark plug 1.

Figure 7:
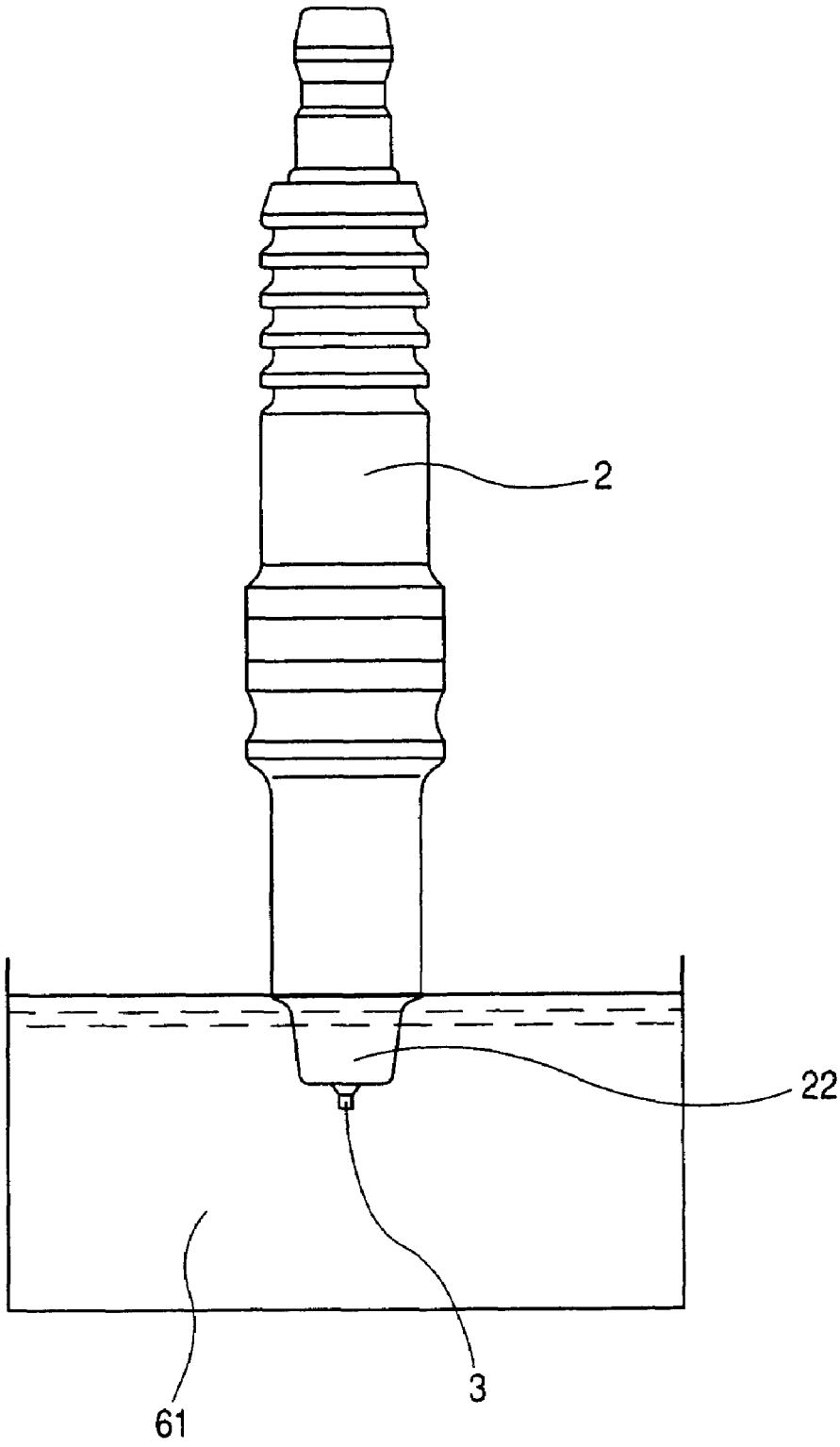
FIG. 7 is a side view which shows how to test the thermal durability of plug samples.

We prepared invention plug samples and comparative plug samples. The invention plug samples were, as illustrated in FIG. 7, the same as those used in the above first tests from which the metal shell 4 was removed. Similarly, the comparative plug samples were the same as those used in the first tests from which the metal shell was removed.

We conducted the tests, as described below, on each of the plug samples under conditions which were more severe than those, as specified by JIS (Japanese Industrial Standards) B8031.

Specifically, we prepared a high-temperature bath 61 filled with tin (Sn) and immersed the insulator nose 22 of each of the plug samples which were initially at ambient temperature in the bath 61 8 mm deep from the top thereof for 30 seconds.

The comparative plug samples were immersed, four in the bath 61 at each of 800° C., 850° C., and 900° C., while the invention plug samples were immersed, four in the bath 61 at each of 850° C., 900° C., and 950° C.

After the tests, we observed whether the porcelain insulator of each of the plug samples had cracked or not. Results of the observation are shown in Table 2. The denominator of each fraction the number of the plug samples used in each test. The numerator indicates the number of the plug samples having cracked.

TABLE 2

| Hot bath Temp. | Invention sample | Comparative sample |
|---|---|---|
| 950° C. | 4/4 | — |
| 900° C. | 0/4 | 4/4 |
| 850° C. | 0/4 | 1/4 |
| 800° C. | — | 0/4 |

The table 2 shows that some of the comparative plug samples cracks at 850° C. and all of them have cracked completely at 900° C., while the invention plug samples do not crack at all even at 900° C.

We also performed quenching durability tests on the porcelain insulator 2 of the spark plug 1.

Figure 8:
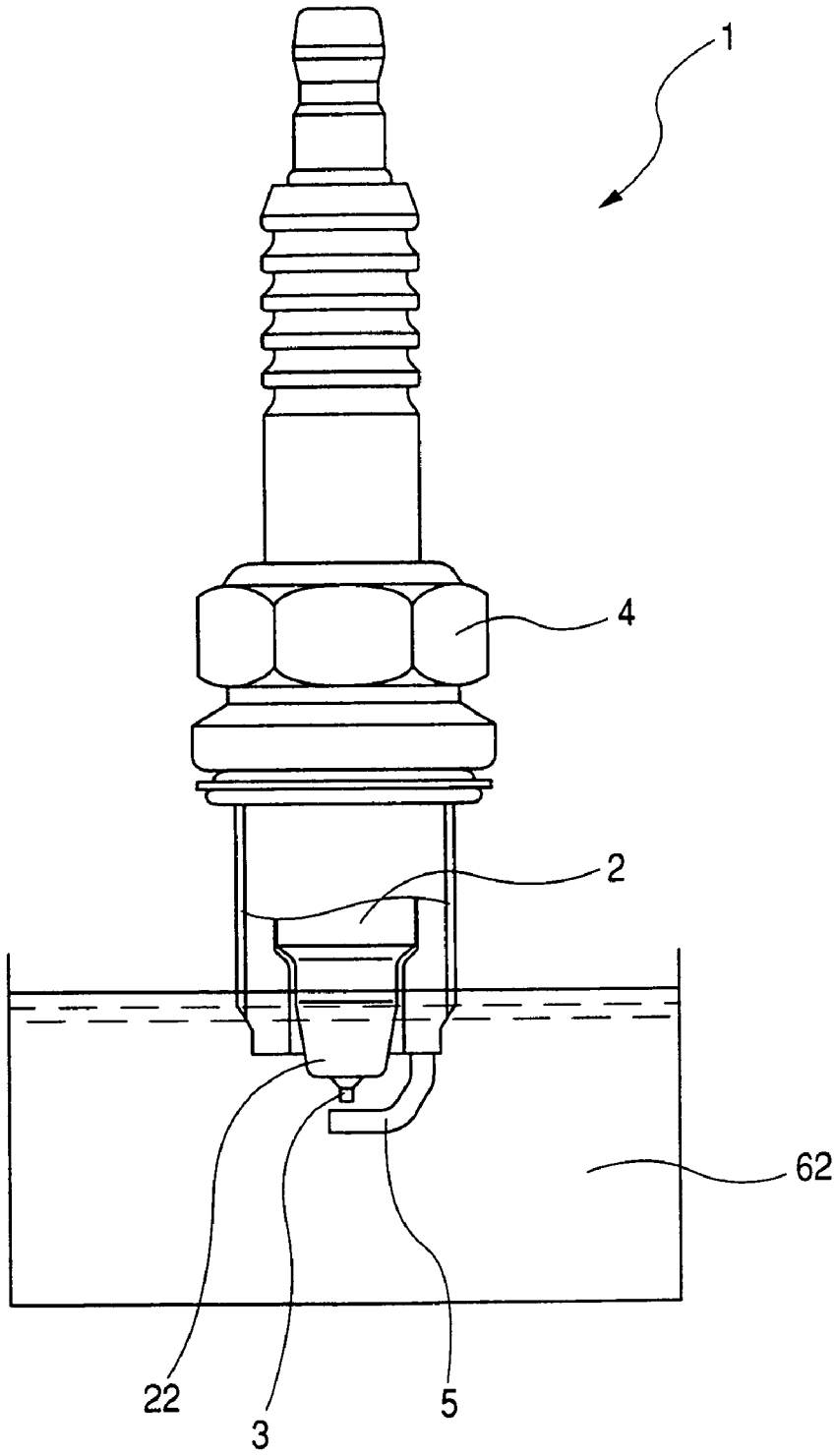
FIG. 8 is a side view which shows how to test the quenching durability of plug samples.

We prepared invention plug samples and comparative plug samples. The invention plug samples were, as illustrated in FIG. 8, the same as those used in the above first tests. Similarly, the comparative plug samples were the same as those used in the first tests.

We conducted the tests on each of the plug samples under conditions which were more severe than those, as specified by JIS (Japanese Industrial Standards) B8031.

Specifically, we heated the plug sample at 240° C. or more within a hot-air furnace for 30 minutes and then immersed the insulator nose 22 thereof in room-temperature water 62 (e.g., 25° C.) 5 mm deep from the top thereof for 5 minutes to cool it.

The comparative plug samples were immersed, four in the water 62 at each of 240° C., 260° C., 280° C., and 300° C. Similarly, the invention plug samples were immersed, four in the water 62 at each of 240° C., 260° C., 280° C., and 300° C.

After the tests, we observed whether the porcelain insulator of each of the plug samples had cracked or not. Results of the observation are shown in Table 3. The denominator of each fraction the number of the plug samples used in each test. The numerator indicates the number of the plug samples having cracked.

TABLE 3

| Furnace Temp. | Invention sample | Comparative sample |
|---|---|---|
| 300° C. | 4/4 | 4/4 |
| 280° C. | 0/4 | 4/4 |
| 260° C. | 0/4 | 0/4 |
| 240° C. | 0/4 | 0/4 |

The table 3 shows that the comparative plug samples cracks when quenched from 280° C., while the invention plug samples do not crack when quenched from 280° C.

It is apparent from the second and third tests that the structure of the porcelain insulator 2 of the spark plug 1 ensures improved thermal durability and quenching durability and may be used in severe conditions such as high-temperature combustion chambers of the internal combustion engines.

We also performed durability tests on the spark plug 1 in severe conditions.

Specifically, we prepared eight invention plug samples and eight comparative plug samples. The invention plug samples were the same as those used in the above first tests. Similarly, the comparative plug samples were the same as those used in the first tests.

We installed each of the plug samples in a typical two-cycle two-cylinder motorcycle engine and run the engine for five cycles each of which is made up of steady-state running where the motorcycle runs at 40 km/h on an even road and high-speed running where the engine runs at an increased speed of as high as 8900 rpm which will induce a sequence of self-ignition events in the engine. The steady-state running was kept for 60 seconds in each cycle. The high-speed running was kept for 15 to 20 seconds in each cycle.

After the tests, we observed the cracking of the insulator nose of each of the plug samples and found that all of the comparative plug samples had cracked, while the invention plug samples had not cracked at all.

Figure 9:
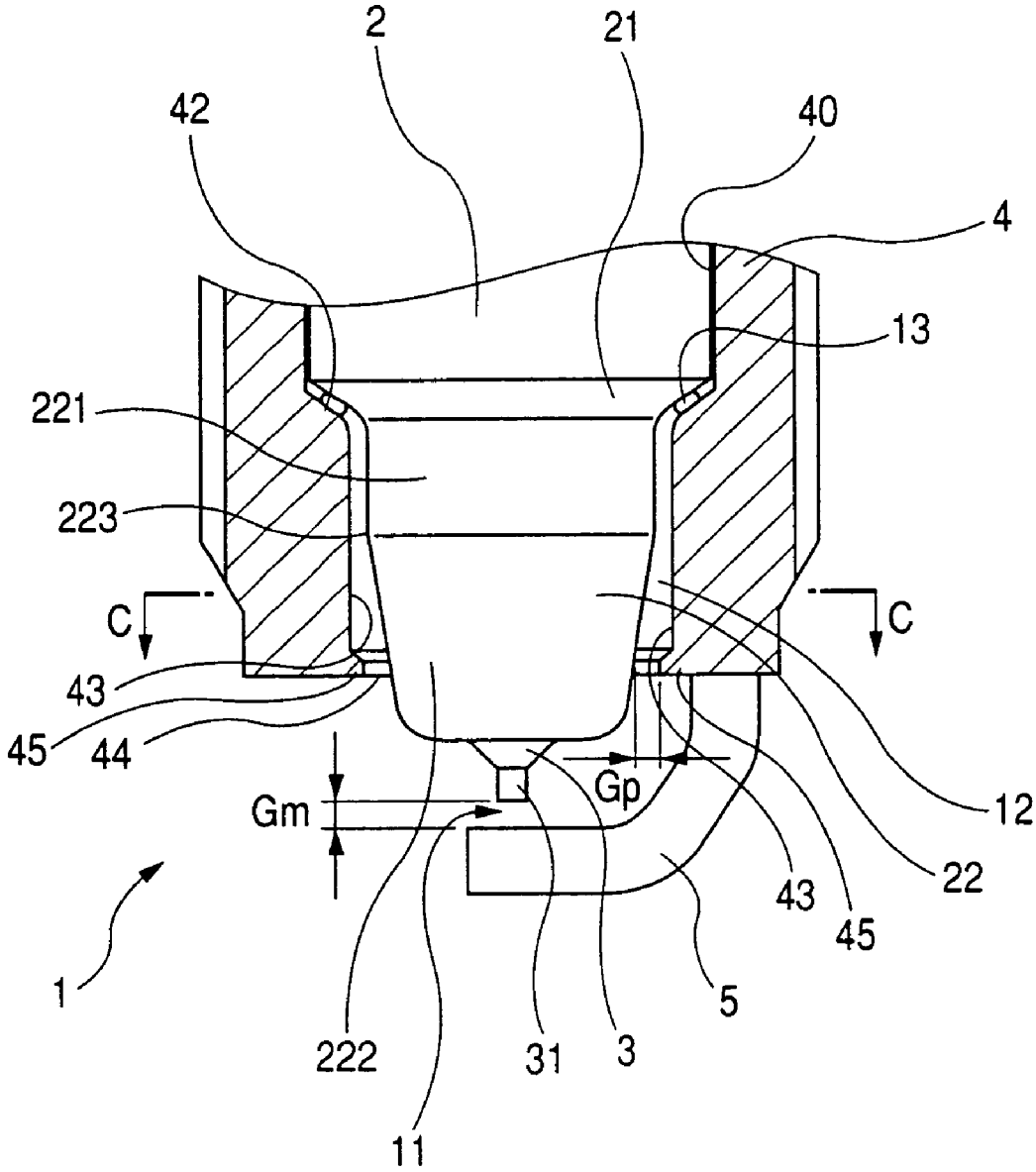
FIG. 9 is a partially longitudinal sectional view which shows a top portion of a spark plug according to the second embodiment of the invention.
Figure 10:
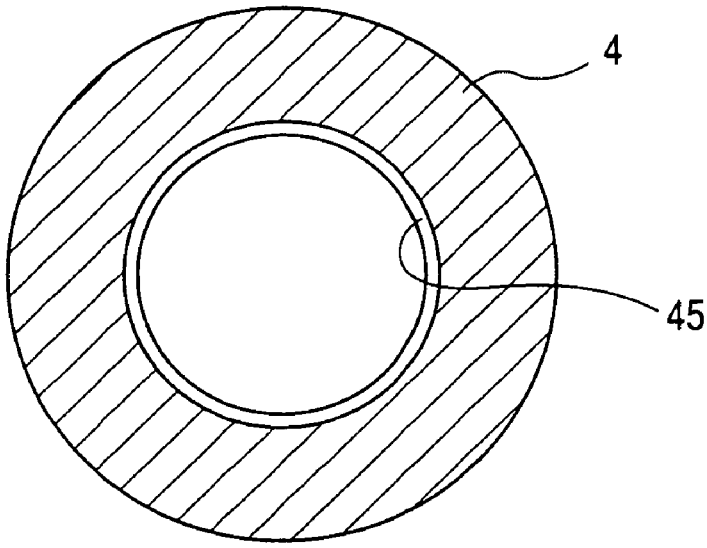
FIG. 10 is a transverse sectional view, as taken along the line C-C in FIG. 9.
Figure 11:
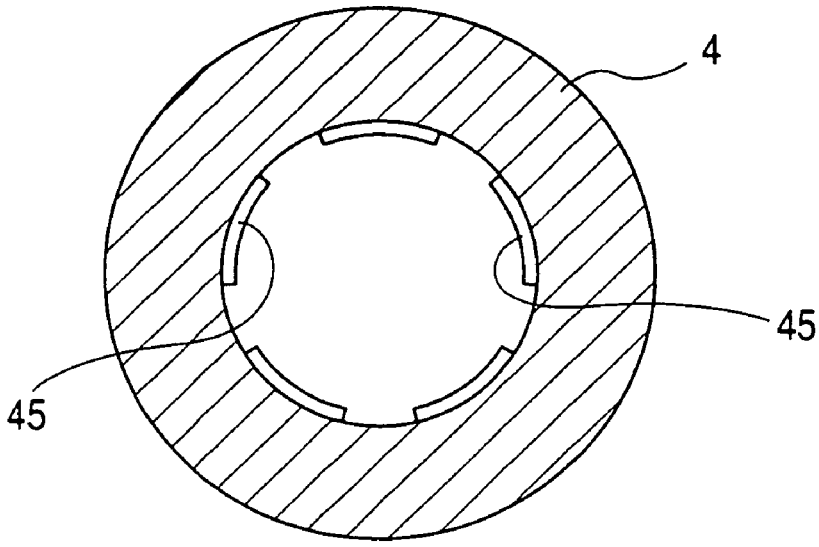
FIG. 11 is a transverse sectional view which illustrates a modification of a porcelain insulator of the spark plug of FIG. 9.

FIGS. 9 to 11 illustrate the spark plug 1 according to the second embodiment of the invention.

The metal shell 4 has an annular protrusion 45 formed on an inner wall 43 of the top end 44 thereof. The annular protrusion 45 extends inwardly of the metal shell 4.

The distance or air gap Gp between the protrusion 45 and the outer wall of the insulator nose 222 of the porcelain insulator 2 and the size Gm of the spark gap 11 are selected to meet a relation of $Gm \leqq Gp \leqq 1.8\ Gm$. The height or distance between the inner top surface of the protrusion 45 and the inner wall 43 of the metal shell 4 is 0.2 mm to 2.4 mm.

The protrusion 45, as clearly illustrated in FIG. 10, extends over the whole of circumference of the inner wall 43 of the metal shell 4, but may be, as illustrated in FIG. 11, made up of a plurality of arc-shaped sections disposed at regular intervals away from each other.

Other arrangements are identical with those in the first embodiment, and explanation thereof in detail will be omitted here.

The annular protrusion 45 works to minimize the entrance of carbon into the air pocket 12 between the metal shell 4 and the porcelain insulator 2, thereby decreasing a drop in insulation resistance between the center electrode 3 and the metal shell 4, which results in increased time between the occurrence of the tracking and the drop in insulation resistance.

The air gap Gp between the protrusion 45 and the outer wall of the insulator nose 222 of the porcelain insulator 2 is selected to meet the relation of $Gm \leqq Gp \leqq 1.8\ Gm$, thereby ensuring the formation of a sequence of reliable sparks between the center electrode 3 and the ground electrode 5 and also minimizing the entrance of carbon into the air pocket 12 between the metal shell 4 and the porcelain insulator 2.

The protrusion 45 which is, as clearly illustrated in FIG. 10, shaped to extend over the whole of circumference of the inner wall 43 of the metal shell 4 serves to enhance the intrusion of carbon into the packet 12.

The protrusion 45 which is, as illustrated in FIG. 11, made up of the arc-shaped sections has a large number of inner edges which function as sub-ground electrodes when the porcelain insulator 2 is covered with carbon, thereby forming a sequence of sparks between the protrusion 45 and the porcelain insulator 2 to burn off the carbon on the porcelain insulator 2. This eliminates the smoldering condition of the spark plug 1 early.

We also performed anti-smoldering tests to evaluate anti-smoldering properties of the spark plug 1 of the second embodiment.

The tests were carried out in the same manner as in the above described first tests. The invention plug samples, as used in the tests, have substantially the same dimensions as those used in the first tests. The height of the protrusion 45 between the inner top surface thereof and the inner wall 43 of the metal shell 4 was 0.3±0.1 mm. The air gap Gp between the protrusion 45 and the outer wall of the insulator nose 222 of the porcelain insulator was 1.1±0.2 mm.

Figure 12:
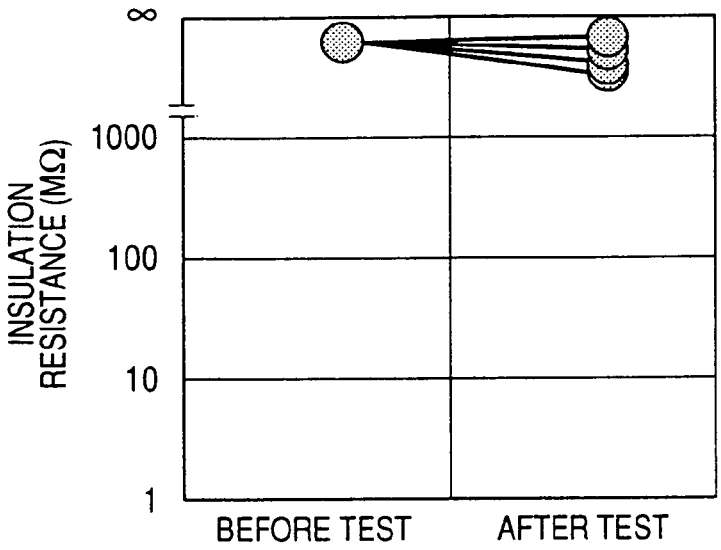
FIG. 12 is a graph which shows experimental results representing changes in insulation resistance between a porcelain insulator and a metal shell of samples of a spark plug in the second embodiment.

We measured the insulation resistance between the center electrode 3 and the metal shell 4 after each tests. Results of the measurements are indicated in a graph of FIG. 12.

The graph shows that all the invention plug samples do not drop in insulation resistance between the center electrode 3 and the metal shell 4 and exhibit the anti-smoldering properties better than those in the structure of the spark plug 1 of the first embodiment. We found that use of the spark plug 1 of the second embodiment permits the drop in insulation resistance to be avoided within 60 seconds after the tracking occurs.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A spark plug for an internal combustion engine comprising:

a hollow metal shell having an inner wall and an inner shoulder formed on the inner wall thereof;

a porcelain insulator having an outer wall and an outer shoulder formed on the outer wall thereof, said porcelain insulator being disposed inside said metal shell with the outer shoulder of the porcelain insulator in abutment with the inner shoulder of said metal shell so as to extend in a longitudinal direction of the spark plug;

a center electrode disposed inside said porcelain insulator;

a ground electrode joined to said metal shell to define a spark gap between itself and said center electrode; and an insulator nose that is a portion of said porcelain insulator and continues from the outer shoulder to a top end of said porcelain insulator, said insulator nose including an upright portion extending from the outer shoulder and a tapered portion extending from the upright portion to the top end of said porcelain insulator, the upright portion having an outer peripheral surface extending substantially parallel to a longitudinal center line of the spark plug, the tapered portion being shaped to have a diameter decreasing from the upright portion toward the top end of said porcelain insulator, the tapered portion having an outer peripheral surface shaped to have an outline one of extending straight and being curved outwardly on a place, as defined to extend through the longitudinal center line of the spark plug;

wherein said upright portion has a length of 1.5 mm to 6 mm which is selected to lie in a range of 7% a to 40% of a total length that is the sum of lengths of the outer shoulder and said insulator nose, wherein said insulator nose has a boundary between the outer peripheral surface of the upright portion and the outer peripheral surface of the tapered portion, said boundary being so located as to face an inner face of said metal shell in a radial direction of said spark plug.

2. A spark plug as set forth in claim 1, wherein a size Gm of the spark gap and a distance Gs between the inner wall of said metal shell and an outer periphery of a boundary between the upright portion and the tapered portion of said porcelain insulator are selected to meet a relation of $Gm \geqq Gs \geqq 0.4Gm$.

3. A spark plug as set forth in claim 1, wherein the upright portion of said insulator nose has an outer surface continuing to an outer surface of the tapered portion through a rounded surface shaped to have an outline curved on a plane, as defined to extend through the longitudinal center line of the spark plug, said rounded surface defining said boundary.

4. A spark plug as set forth in claim 1, wherein said center electrode has a noble metal chip joined to a top end thereof which faces the spark gap.

5. A spark plug as set forth in claim 4, wherein the noble metal chip has a diameter of 0.7 mm or less.

6. A spark plug as set forth in claim 4, wherein the noble metal chip is made of Iridium alloy.

7. A spark plug as set forth in claim 1, wherein a total length that is the sum of lengths of the outer shoulder of said porcelain insulator and said insulator nose is 11 mm or less.

8. A spark plug as set forth in claim 1, wherein said metal shell has an inner peripheral surface which extends from the inner shoulder to a top end thereof facing the spark gap in parallel to the longitudinal center line of the spark plug.

9. A spark plug as set forth in claim 1, wherein a protrusion is formed on a top end portion of said metal shell facing the spark gap, the protrusion extending inwardly of said metal shell.

10. A spark plug as set forth in claim 9, wherein a distance Gp between an inner end surface of the protrusion and the outer wall of said porcelain insulator and a size Gm of the spark gap are selected to meet a relation of $Gm \leqq Gp \leqq 1.8\ Gm$.

11. A spark plug for an internal combustion engine comprising:

a hollow metal shell having an inner shoulder formed on an inner wall thereof;

a porcelain insulator having an outer shoulder formed on an outer wall thereof, said porcelain insulator being disposed inside said metal shell in abutment of the outer shoulder with the inner shoulder of said metal shell so as to extend in a longitudinal direction of the spark plug;

a center electrode disposed inside said porcelain insulator;

a ground electrode joined to said metal shell to define a spark gap between itself and said center electrode; and an insulator nose that is a portion of said porcelain insulator and continues from the outer shoulder to a top end of said porcelain insulator, said insulator nose including an upright portion and a tapered portion extending from the upright portion to the top end of said porcelain insulator, the upright portion having an outer peripheral surface extending substantially parallel to a longitudinal center line of the spark plug, the tapered portion being shaped to have a diameter decreasing from the upright portion toward the top end of said porcelain insulator, the tapered portion having an outer peripheral surface shaped to have an outline one of extending straight and being curved outwardly on a place, as defined to extend through the longitudinal center line of the spark plug;

wherein a protrusion is formed on a top end portion of said metal shell facing the spark gap, the protrusion extending inwardly of said metal shell, wherein a distance Gp between an inner end surface of the protrusion and the outer wall of said porcelain insulator and a size Gm of the spark gap are selected to meet a relation of $Gm \leqq Gp \leqq 1.8\ Gm$.

* * * * *